United States Patent [19]

Lafreniere et al.

[11] 4,274,571

[45] Jun. 23, 1981

[54] CARRIER FOR SKIS AND SKI POLES

[76] Inventors: Earl W. Lafreniere, General Knox Rd., Russell; Douglas S. Jack, Birch Bluff Rd., Montgomery, both of Mass. 01071

[21] Appl. No.: 127,190

[22] Filed: Mar. 4, 1980

[51] Int. Cl.[3] ..... A45C 71/00

[52] U.S. Cl. ..... 294/147; 224/917; 211/60 SK; 280/814

[58] Field of Search ..... 224/311, 45 S, 917; 280/814, 815; 211/60 SK

[56] References Cited

U.S. PATENT DOCUMENTS

| | | | |
|---|---|---|---|
| 3,262,619 | 7/1966 | Selnes | 224/50 |
| 3,370,766 | 2/1968 | Woolworth | 224/45 S |
| 3,504,405 | 4/1970 | Elliott-Smith | 224/45 R X |
| 3,892,343 | 7/1975 | Warner | 280/814 X |
| 3,935,977 | 2/1976 | Bonnett | 224/45 S |
| 3,985,275 | 10/1976 | Allen | 280/814 |
| 3,990,655 | 11/1976 | Covell | 280/814 X |
| 4,002,277 | 1/1977 | Westerholm | 224/45 S |
| 4,059,209 | 11/1977 | Grisel | 224/45 S |
| 4,221,314 | 9/1980 | Baker, Jr. | 224/45 S |

*Primary Examiner*—Steven M. Pollard
*Attorney, Agent, or Firm*—Ross, Ross & Flavin

[57] ABSTRACT

A hand-held carrier for a pair of skis and a pair of poles includes a pair of confrontable clamping members hingedly interconnected at their lower ends. The members when in confrontation define a pair of adjacent ski-receiving openings (each for receiving the mid-section of a ski) and a pair of adjacent pole-receiving openings, (each for receiving the mid-section of a pole). The upper ends of the clamping members are releasably interengaged and are latched together by a latching means. A pivotable handle is mounted on one of the clamping members and may be swung as to allow a reduction in the space required by the carrier when loaded onto a car rack, thereby permitting the use of a greater plurality of carriers and supported skis and poles on a particular car. When the skis and poles are clamped in their openings, their longitudinal axes extend in parallelism and perpendicular to the longitudinal axes of the clamping members with the skis and poles being disposed in a side-by-side relationship in a single plane. The assembly may be conveniently carried by the handle and may be conveniently secured relative to a carrier atop a vehicle. Each ski-receiving opening is constituted by one portion for accommodating a ski of a more narrow width and another portion for accommodating a ski of a more wide width according to the desires and needs of the particular owner.

6 Claims, 1 Drawing Figure

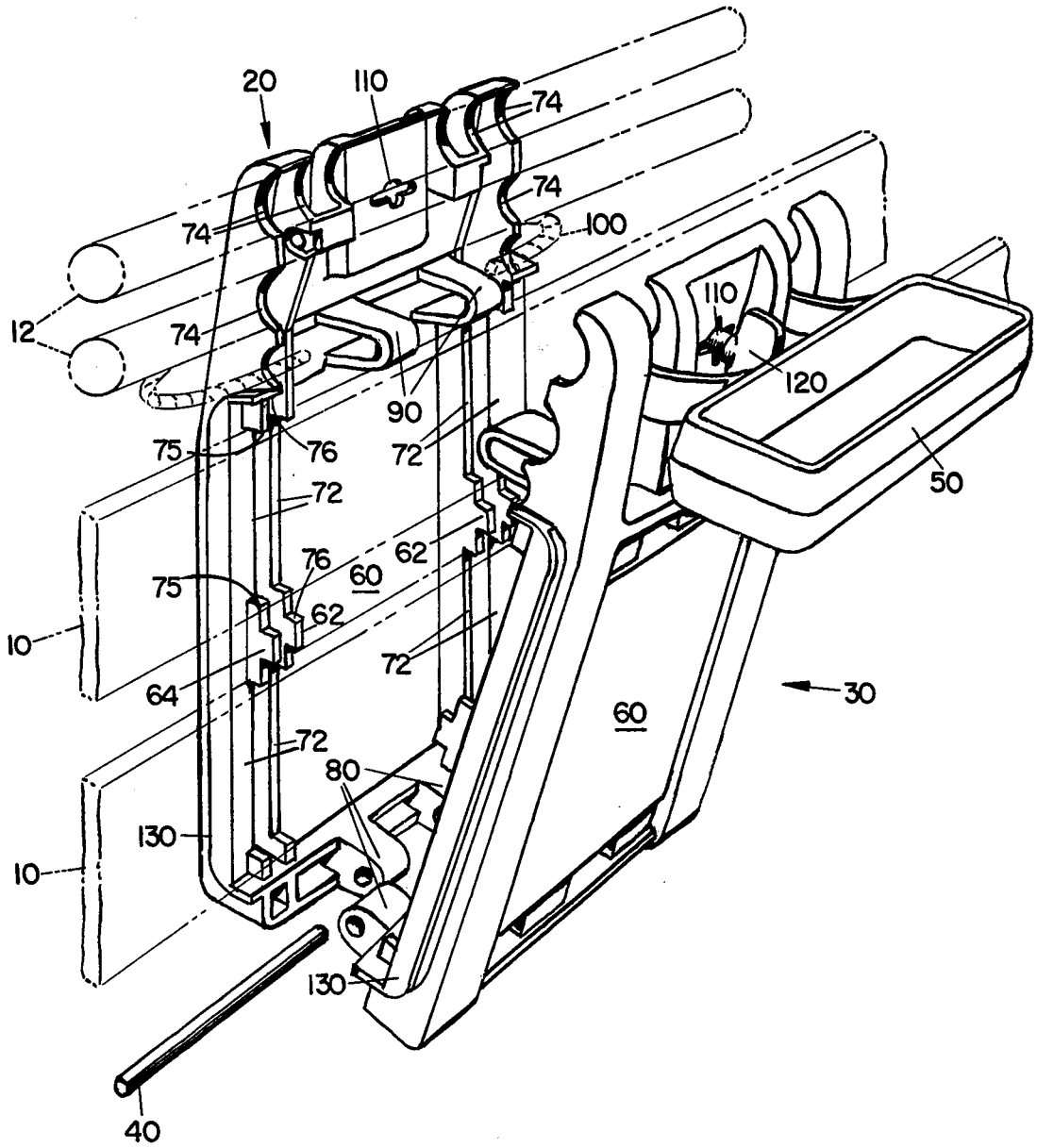
20
110
74
74
74
100
12
74
110
120
90
75
76
72
50
72
76
62
60
75
62
10
72
64
30
60
72
80
130
10
130
40

CARRIER FOR SKIS AND SKI POLES

This is a carrier for skis and ski poles making it possible to hold same in spaced relationship to facilitate their being carried by the side of a person in a manner much as that person carries a brief case and/or their being mounted as a unit (carrier complete with skis and ski poles) on an appropriate mounting atop a vehicle.

The carrier is especially unique for the reason that it is adapted for the carriage of either the cross country type of ski or the downhill (Alpine) type of ski, the latter being wider than the former, as known.

The carrier firmly grips the skis and poles, each at the balance thereof, in a side-by-side relationship as to each other.

Skis and poles, if merely bundled and carried over the shoulder, make an unwieldly dangerous load, difficult to balance. Skis flung over the shoulder are inclined to swing offering a potential source of injury to other skiers and passersby. Such a system is particularly troublesome for children.

Some prior art carriers make use of heavy frames involving intricate locking mechanisms for discouraging theft and further involving bulky structures for gripping the skis on opposite sides of the bindings to the end that the load is well balanced.

The known prior art does not teach a satisfactory lightweight device for securing the skier's equipment so that it may be easily transported by hand and may be conveniently secured when mounted atop a vehicle and may be easily stored when not in use. More specifically, no carrier is known to exist wherein a carrying handle is pivotally arranged so as to allow the swinging of the handle into an out-of-the-way position when the carrier is to be loaded upon a vehicle top rack. The common compact car racks normally accommodate four sets of skis and poles and the novel arrangement hereof allows four carriers each complete with its set of skis and poles to be transported on a compact car ski rack.

Ski carrying devices of the known prior art have consistently incorporated a bottom-to-bottom sandwiching technique in the case of the skis. This allows the abutment of the two flat surfaces of the skis when carried, but it dictates that they be separated and repositioned when placed on the majority of the presently available car-top racks.

As far as we are aware, the prior art has not shown ski poles disposed in the same plane as the skis in a compact carrier so as to allow easy storage on the most popular types of car top racks, except in the case of the U.S. Pat. Nos. to

| | | |
|---|---|---|
| | Selnes | #3,262,619 of July 26, 1966 |
| | Woolworth | #3,370,766 of February 27, 1968 |
| | Elliott-Smith | #3,504,405 of April 7, 1970 |
| | Warner | #3,892,343 of July 1, 1975 |
| and | Westerholm | #4,002,277 of January 22, 1977, |

from each of which we distinguish in significant ways as to compactness and ease of manipulation, not to mention the feature of the swingable handle and the feature of a novel locking mechanism whereby the need for side cores at the molding site or for drilling are avoided.

The carrier allows a disposition of the skis and poles in a side-by-side relationship with all components disposed in a single plane offering the obvious advantage that the skis and poles can be taken from their storage location directly onto most car racks and then removed therefrom and carried to the ski slope as a unit without any removal or repositioning of the components. No cited reference teaches the use of a pivotal handle designed to allow full utilization of the ski rack space, that is permitting the swinging of the handle upwardly to an out-of-the-way position so as to provide more space for other skis and poles atop a vehicle.

In this invention, an inexpensive carrier is taught which is effective in obviating the above referred to difficulties. It teaches similar elongated clamping members, interconnected by a hinge at their lower ends to bring them into and out of confronting relation with each other. Each clamping member has a series of spaced, inwardly-opening recesses which coact with the complemental recesses of the other clamping member to define openings through the opposite end walls of the carrier when the clamping members assume their confronting relationship.

In use, a carrier latch mechanism is first released and the clamping members may then be pivoted about a hinge to assume the opened position. Skis and poles may then be disposed in the recesses of one of the clamping members with the longitudinal axes of the skis and poles extending perpendicular to the longitudinal axis of the said one clamping member. The other clamping member may then be pivoted about the hinge to assume the closed position wherein the confronting inner surfaces of the clamping members abut.

The latch mechanism may then be reengaged to hold the clamped members in their locked-together position, with the skis and poles being securely clamped therebetween.

To carry skis and poles more easily, it is desirable to clamp them at or near the central portion thereof so as to balance the load and to hold same against shifting as the skier walks therewith or as the equipment is transported atop a vehicle or stored when not in use. Thus we provide a carrier having opposed clamping members for securely engaging the skis and ski poles so that they may be easily transported.

The invention comprehends a hand-held carrier for supporting either skis or poles or both and having opposed clamping members with separate, cushioned openings for separately receiving the skis and poles, the carrier being configured for use with different sets of skis having different dimensions.

Twin, elongated clamping members are interconnected by a hinge and, when brought together, define spaced ski-receiving openings and pole-receiving openings such that, when the skis and the poles are extended through the openings, the clamping members may be fastened together to rigidly secure the skis and poles relative to the carrier.

In the drawing:

The FIGURE is an exploded isometric view of the carrier of the invention shown in opened position with a pair of narrow cross country skis and a pair of poles being shown fragmentarily and in phantom.

In the FIGURE, we show the carrier with a pair of narrow, cross country skis 10, 10 and a pair of poles 12, 12, shown fragmentarily and in phantom, in position in the appropriate respective recesses of one of the clamping members.

The carrier consists of a pair of identical elongated clamping members 20, 30 which may be constructed of an appropriate material such as plastic.

The clamping members are interconnected at the lower ends thereof by a hinge pin 40, as will be referred to subsequently.

The upper end of clamping member 30 mounts a handle 50 pivotally engaged therein, which handle may be swung between a vertically-disposed carrying position upwardly of the clamping members when same are in closed position and a horizontally-disposed non-carrying position (as shown) extending outwardly of clamping member 30 in a plane normal to the plane of the longitudinal axis of the clamping member, the latter position serving use in a car rack where the use of reduced space is so all essential.

Each clamping member 20, 30 embodies a longitudinally-extending web 60 and oppositely-disposed inner and outer end walls 62, 64 respectively. That is, at each end of web 60, a pair of spaced longitudinally-extending end walls are provided, which end walls extend inwardly (in a confronting relationship when the clamping members are assembled), and which end walls extend throughout the full lengths of the clamping members.

The innermost edges of inner and outer end walls 62 and 64 are provided with recesses, namely a pair of side-by-side ski recesses 72, 72 and a pair of side-by-side pole recesses 74, 74.

Each ski recess 72 is provided with a double cavity configuration identified by a first pair of opposed side walls 75, 75 spaced a certain distance apart for accommodating in the defined rectangular in cross section configuration the narrower and thicker type of cross country ski and further identified by a second pair of opposed side walls 76, 76 spaced a distance apart greater than the said certain distance for accommodating in the defined rectangular in cross section configuration the wider and thinner type of Alpine ski.

Stated in another way, each ski receiving recess can be considered to comprise, in actuality, two recesses-one for the more narrow type of ski in one plane and one for a more wide type of ski in another plane inboard of the said one plane.

Ski recesses 72 are each of generally rectangular cross-sectional configuration and pole recesses 74 are each of semi-circular cross-sectional configuration.

Hinge pin 40 is extendable through suitable openings in pairs of inwardly-facing interdigitated bosses 80 and is frictionally held relative thereto so that the clamping members may be swung between opened and closed positions.

Between the ski recesses and pole recesses, pairs of interdigitated loops 90 extend inwardly from the back of each clamping member and define, when the clamping members are swung into the closed position, a through opening through which a securing cable 100 may be passed for purposes of interlocking the clamping members to each other, there being a locking member such as a lock (not shown) for securing the opposite free ends of the cable to each other.

Each clamping member additionally will be provided with a key slot 110 extended through the back thereof. When the clamping members are brought into closed position as to each other, the key slots are so aligned that a key 120 may be extended therethrough so as to aid in holding the clamped members in latched relationship. The key is held captive relative to one clamping member and is provided with an enlarged knob on the visible side thereof. Once extended through the slot of the opposed clamping member, the key is rotated 90° to obtain the latching effect.

When the carrier is in an opened position, wherein the clamping members are pivoted outwardly about hinge pin 40, skis 10, 10 may be inserted into the ski recesses 72, 72 of one of the clamping members. In order to balance the load, it is preferred to retain the central portion of the skis as close to the recesses as possible.

Poles 12, 12 are also retained in recesses 74, 74 at or near the central portion thereof. These recesses are mutually spaced and disposed, on the clamping members. The recesses are so disposed that when the skis and poles are placed in the recesses the longitudinal axes of the skis and poles will be disposed in a parallel relationship to each other, and in a perpendicular relationship relative to the longitudinal axis of the clamping member.

The inner surfaces of the recesses may be lined with a resilient material such as sponge rubber or the space between each pair of end walls may be so lined. The lining will serve to accommodate and grip the skis and poles, regardless of dimensions when in a closed position. In this way, the carrier may be used with a wide variety of skis and poles, without regard to the pole diameters or the ski widths or thicknesses.

A lightweight portable carrier for skis and poles has thus been described. The carrier comprises twin elongated clamping members interconnected at their lower ends by a hinge pin and at their upper opposite ends by a releasable latching means. The clamping members define six mutually spaced recesses. The first and second and third and fourth recesses, adjacent the hinge pin, are rectangular and adapted to receive the skis disposed in side-by-side relationship. The upper two recesses are adapted to receive each of the two poles in a side-by-side relationship coplanar with the skis.

When the carrier is in a closed position wherein the inner surfaces of the clamping members abut, a pair of skis and a pair of ski poles may be secured in the openings for transportation, and a handle is provided therefor, adjacent the locking member.

Outwardly projecting flanges 130 extend longitudinally along each side of each clamping member and serve to provide an attaching means for the attachment of the protective ski or binding covers.

The protection which is sought for this invention is covered by the language of the above specification and the spirit represented thereby. It should be appreciated that its utility and application may extend beyond the particular type of carrier illustrated and its broad scope and concept comprehend the useful and novel features set forth when combined with other equipment in other ways.

The claims are desired to include within the scope thereof all of said suitable variations, modifications and equivalents by which substantially the results of the invention may be obtained through the use of substantially the same or equivalent devices or means. Accordingly, limitation hereof should only be made as determined by a proper interpretation of the prior art and the scope of the subjoined claims, in which it is our intention to claim all novelty inherent herein as broadly as possible.

We claim:

1. A device for accommodating a pair of skis and a pair of ski poles in the stored position or the transported position as mounted atop a vehicle or the transported position as hand-carried comprising in combination: identical elongated clamping members each defining four inwardly-opening recesses mutually spaced therealong, two of the recesses each adapted to receive a central portion of a ski and two of the recesses each adapted to receive a central portion of a ski pole with the skis and poles being disposed in a side-by-side relationship along a common plane and along parallel axes normal to the longitudinal axes of the clamping members; the ski recesses being of generally rectangular configuration in cross section with stepped opposite side walls defining first portions spaced a certain distance apart from each other for accommodating skis of one width and second portions spaced apart from each other a distance greater than the said certain distance for accommodating skis of another width, hinge means interconnecting the clamping members for pivotal movements between an opened position wherein the central portions of the skis and ski poles are receivable between the clamping members and a closed position wherein the inner faces of the clamping members are in confrontation for holding the skis and ski poles therebetween, latching means for releasably holding the clamping members in the closed position, and handle means carried by one of the clamping members adjacent an end thereof for carrying the device.

2. In the device of claim 1, the handle means being pivotable relative to the clamping members for reducing the space required by the carrier when loaded on a car rack.

3. In the device of claim 1, with a flange projecting outwardly from each side of each clamping member for the mounting of protective ski covers.

4. In the device of claim 1, with a captive latching pin extendable from one clamping member through the other clamping member for the interlocking of the two clamping members in closed position.

5. A carrier for accommodating a pair of skis and a pair of ski poles disposed in a side-by-side relationship along a common plane in the stored position or the transported position as mounted atop a vehicle or the transported position as hand-carried comprising in combination: identical elongated clamping members each defining four inwardly-opening recesses mutually spaced therealong, two of the recesses each adapted to receive a central portion of a ski and two of the recesses each adapted to receive a central portion of a ski pole; the ski recesses being of generally rectangular configuration in cross section with stepped opposite side walls defining a first section for accommodating skis of one width and a second section for accommodating skis of another width, hinge means interconnecting the clamping members for facilitating pivotal movement between an opened position wherein the central portions of the skis and ski poles are receivable relative to the clamping members and a closed position wherein the inner faces of the clamping members are disposed in confrontation for holding the skis and ski poles therebetween, latching means for releasably holding the clamping members in the closed position, and pivotable handle means carried by one of the clamping members adjacent an end thereof for carrying the device.

6. A device for selectively supporting a pair of skis and a pair of ski poles in the stored or mounted-atop-a-vehicle or hand-carried positions comprising: identical elongated clamping members each defining a quartet of inwardly-opening recesses mutually spaced therealong, two of the recesses each adapted to receive a central portion of a ski and two of the recesses each adapted to receive a central portion of a ski pole for the disposition of the skis and poles in a side-by-side relationship along a common plane and in parallel axes normal to the longitudinal axes of the clamping members; the ski recesses having stepped opposite side walls defining first portions spaced apart from each other a certain distance for accommodating skis of one width and second portions spaced apart from each other a distance greater than said certain distance for accommodating skis of another width, hinge means interconnecting the clamping members for pivotal movements between opened position with the central portions of the skis and ski poles being receivable between the clamping members and closed position with the inner faces of the clamping members being in confrontation for holding the skis and ski poles therebetween, and means for releasably holding the clamping members in the closed position.

* * * * *